United States Patent [19]

Röck et al.

[11] 4,412,366

[45] Nov. 1, 1983

[54] ADJUSTABLE HINGE

[75] Inventors: Erich Röck, Höchst; Klaus Brüstle, Lauterach, both of Austria

[73] Assignee: Julius Blum Gesellschaft m.b.H., Höchst, Austria

[21] Appl. No.: 238,557

[22] Filed: Feb. 26, 1981

[30] Foreign Application Priority Data

Feb. 26, 1980 [AT] Austria ..... 1047/80
Dec. 1, 1980 [AT] Austria ..... 5848/80

[51] Int. Cl.[3] ..... E05D 7/04
[52] U.S. Cl. ..... 16/236
[58] Field of Search ..... 16/236, 245, 246

[56] References Cited

U.S. PATENT DOCUMENTS 4,313,239 2/1982 Tsuneki ..... 16/236

FOREIGN PATENT DOCUMENTS 2356000 5/1975 Fed. Rep. of Germany ..... 16/236
2730558 1/1978 Fed. Rep. of Germany ..... 16/236
1478801 7/1977 United Kingdom ..... 16/236
2657628 6/1978 United Kingdom ..... 16/236

*Primary Examiner*—Werner H. Schroeder
*Assistant Examiner*—Andrew M. Falik
*Attorney, Agent, or Firm*—Wenderoth, Lind & Ponack

[57] ABSTRACT

A hinge for furniture doors is adjustable in three directions, i.e. in the direction of the depth of an article of furniture, in the direction of the height of the article of furniture and in the direction of the breadth of the door joint. Adjustment is effected by moving a hinge arm of the hinge with respect to a base plate on which the hinge arm is mounted. The hinge arm has a U-shaped cross section. A guiding member which is a rhomboid plate or a rectangular plate with oblique slots is positioned in the U of the hinge arm and has oblique faces sliding along corresponding faces on the base plate. Side edges of the guiding member slide along side flanges of the hinge arm. For height adjustment the hinge arm is not moved on a straight line but along a curve or two straight lines that are at an angle to each other.

11 Claims, 13 Drawing Figures

ADJUSTABLE HINGE

BACKGROUND OF THE INVENTION

1. Field of the Invention

This invention relates to a hinge which is adjustable in the direction of the height of an article of furniture comprising a hinge arm of U-shaped cross-section linked to a hinge housing or the like by means of an axle or axles and hinge links, the hinge arm in the mounted position being fastened to a part of the article of furniture, e.g. a side wall, by means of a supporting member, which is a base plate or an intermediate member anchored to a base plate, the hinge arm being retained on the supporting member by means of a clamping screw.

2. Description of the Prior Art

Hinges used in modern furniture construction should allow various possibilities of adjustment. Such adjustment should compensate any inaccuracies which may have been caused when the fastening holes are drilled into parts of the article of furniture, such as the side wall and the door.

Most hinges allow an adjustment in the direction of the depth of the article of furniture and in the direction of the breadth of the door joint.

These two possibilities of adjustment require only simple constructional means.

It is, however, often desired to adjust the hinge arm and, thus, the door in the direction of the height of the article of furniture. Various designs have already been suggested in this respect.

Difficulties in effecting a height adjustment in a hinge are due to the fact that the door presses downwards and it may happen that the hinge arm, which is not positively retained on the base plate, is pressed downwards in the course of time by the weight of the door, so that the hinge arm is moved from the height position which has been chosen when assembling the piece of furniture.

In order to eliminate this disadvantage, the means allowing a height adjustment of the hinge are usually over-dimensioned, when compared to the rest of the hinge.

As a result, the hinge is expensive, its design is adversely affected, and it is difficult to handle it during assembling operations.

SUMMARY OF THE INVENTION

It is, therefore, the object of this invention to provide a hinge of the afore-described type in which a height adjustment can be effected in a simple manner, in which the means for height adjustment require only little space in the hinge arm and in which the adverse effect that the hinge arm is pulled downwards by the weight of the door wing is largely eliminated.

According to the invention, this is achieved by providing a guiding member in the profile of the hinge arm by means of which the hinge arm is movably guided parallel to the mounting plane of the base plate, obliquely as well as vertically to the rotational axis of the hinge.

It is preferably provided that the guiding member is first movable on guiding faces of the supporting member or of the hinge arm, such guiding faces being oblique to the rotational axis of the hinge and parallel to the mounting plane of the base plate, and, second, either that the guiding member laterally engages the base plate and is movably guided on the base plate vertically to the rotational axis of the hinge, or that the guiding member rests with its lateral faces at least partially on the lateral flanges of the hinge arm, and that the guiding member is movable relative to the lateral flanges and vertically to the rotational axis of the hinge.

The guide faces on the guiding member could, for example, be formed by the front faces of the guiding member. It is, however, preferably provided that the guiding member has longitudinal recesses or slots in which projections of the supporting member engage.

Preferred embodiments of the invention provide that the guiding member is, with respect to the longitudinal center axis of the hinge arm, movably guided on oblique projections of the intermediate member and that the side faces of the guiding member rest at least partially on the lateral flanges of the hinge arm, or that the guiding member is movably guided on projections of the base plate being oblique to the longitudinal center axis of the hinge arm and that the side faces of the guiding member rest at least partially on the lateral flanges of the hinge arm.

The guiding member may be a metal plate.

It is further preferably provided that the guiding member is, on its side faces, provided with concentric recesses so that slide faces are formed on opposite end portions of each side face. Only the slide faces rest on the lateral flanges of the hinge arm.

Due to the fact that the entire side faces of the guiding member do not rest on the flanges of the hinge arm, friction is substantially reduced, and the adjustment and displacement of the hinge is facilitated when it is moved in the longitudinal direction of the hinge arm.

Moreover, it is much easier to provide slide faces which fit snugly but movably on the parallel flanges of the U-shaped profile of the hinge arm over a short range than over the total length of the guiding member.

BRIEF DESCRIPTION OF THE DRAWINGS

In the following various embodiments of the invention will be described in greater detail with reference to the accompanying drawings, without being limited thereto, and wherein.

DESCRIPTION OF THE PREFERRED EMBODIMENTS

Figure 5:
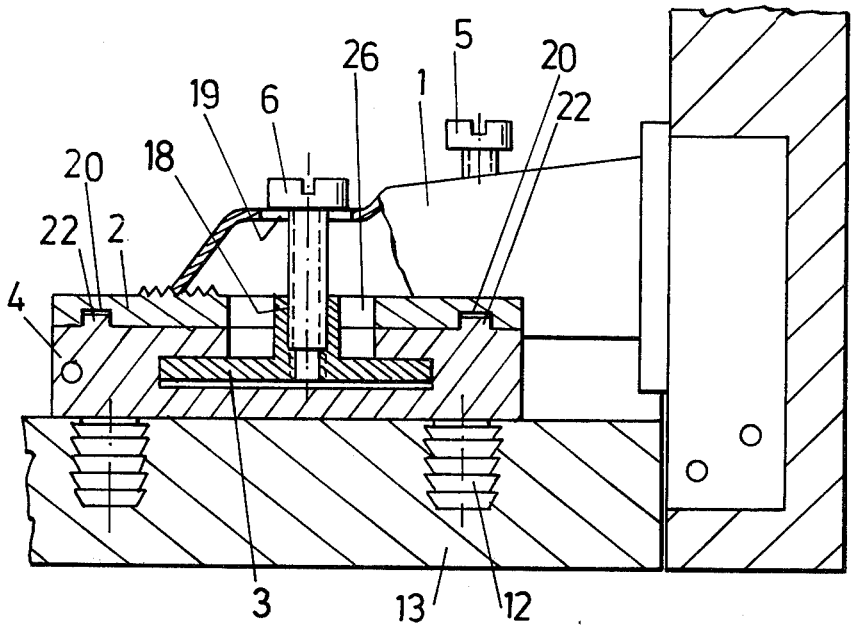
FIG. 5 is a side view of a further embodiment of the invention, parts thereof being shown in section.
Figure 6:
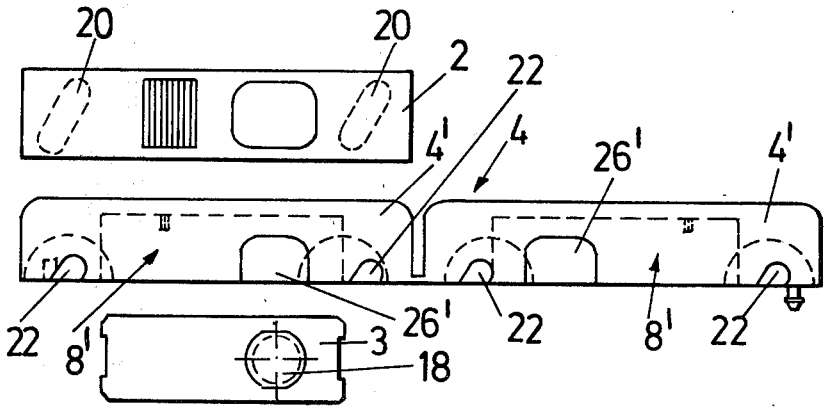
FIG. 6 is a top view of the base plate and of those parts which are mounted directly thereon and therein.
Figure 7:
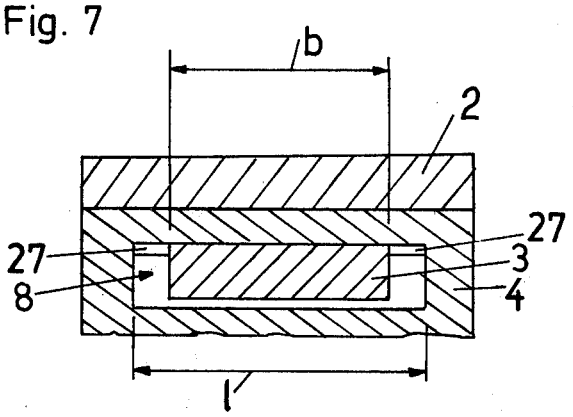
FIG. 7 is a cross-sectional view of a base plate.

The embodiment according to FIGS. 1 through 4 and 12 shows a hinge which is adjustable in the direction of the depth of the article of furniture as well as in the direction of the breadth of the door joint and in the direction of the height of the article of furniture. This is also true for the embodiment according to FIGS. 5 through 7, the adjustment of the door joint will, however, not be described in the specification.

The hinge according to FIGS. 1 through 4 and 12 comprises a base plate 4, an intermediate member 3, a guiding member 2 and a hinge arm 1.

The hinge arm 1 is linked to a hinge casing 9 by means of hinge links which are mounted on axles 10 and which have not been illustrated.

The hinge casing 9 is, in the mounted position, inserted into a bore of a door 11 of the article of furniture.

The base plate 4 is fastened to a side wall 13 of the article of furniture by means of screws or dowels 12.

The intermediate member 3 is anchored to the base plate 4. In the front, i.e. on the side directed towards the door 11, member 3 is anchored by means of a joint adjusting screw 5 and in the rear, i.e. on the side directed away from the door 11, member 3 is anchored by means of a clamping screw 7.

The joint adjusting screw 5 is mounted in a female thread 14 in the intermediate member 3 and extends with its head 5' into a T-shaped recess 15 which is open towards the front side of the base plate 4.

If the clamping screw 7 is loosened, the intermediate member 3 can be moved in the direction of double arrow F by turning the joint adjusting screw 5. Hence, the hinge arm 1 positioned on the intermediate member 3 is with its hinge link axles 10 adjusted in the direction of the breadth of the door joint.

If the clamping screw 7 is loosened, the intermediate member 3 can, together with the hinge arm 1, be adjusted in the direction of double arrow T, whereby an adjustment of the hinge in the direction of the depth of the article of furniture is effected. After the adjusting operation, the clamping screw 7 is fastened, and the hinge is fixed in the direction of the depth of the article of furniture.

The hinge arm 1 is retained on the intermediate member 3 by means of a height adjusting screw 6.

The height adjusting screw 6 is mounted in a female thread 18 in the intermediate member 3 and extends through a hole 19 in the hinge arm 1.

The guiding member 2 is arranged between the hinge arm 1 and the intermediate member 3.

As illustrated in the drawings, the guiding member 2 is provided with longitudinal slots 20 which are obliquely aligned to the longitudinal center axis L of the hinge arm 1 and of the base plate 4.

Slots 20 form guiding faces 21 for corresponding guiding faces 21 on projections 22 of the intermediate member 3.

The guiding member 2 is on its side faces provided with concentric recesses 23. At the front and rear portions of guiding member 2 are slide faces 24 adjacent to respective recesses 23, slide faces 24 lying immediately adjacent to lateral parallel walls or flanges 1' of the hinge arm 1.

Figure 1:
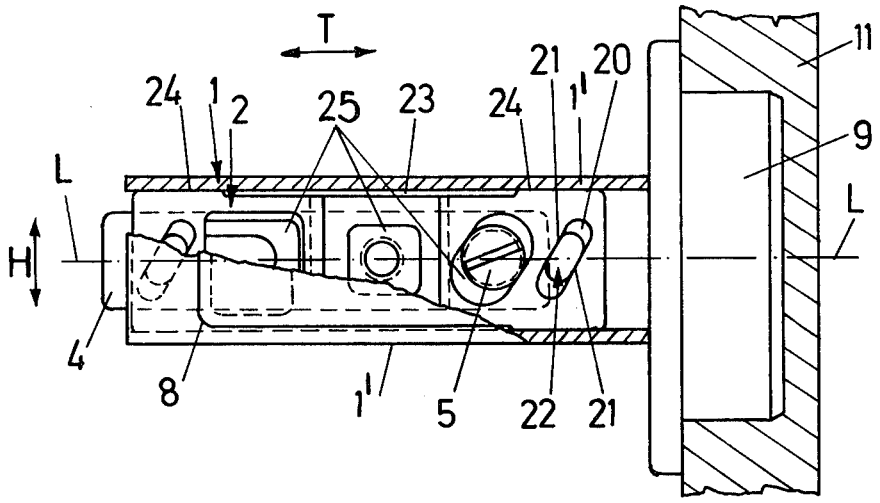
FIG. 1 is a top view of a hinge according to the invention, parts thereof being shown in section.
Figure 2:
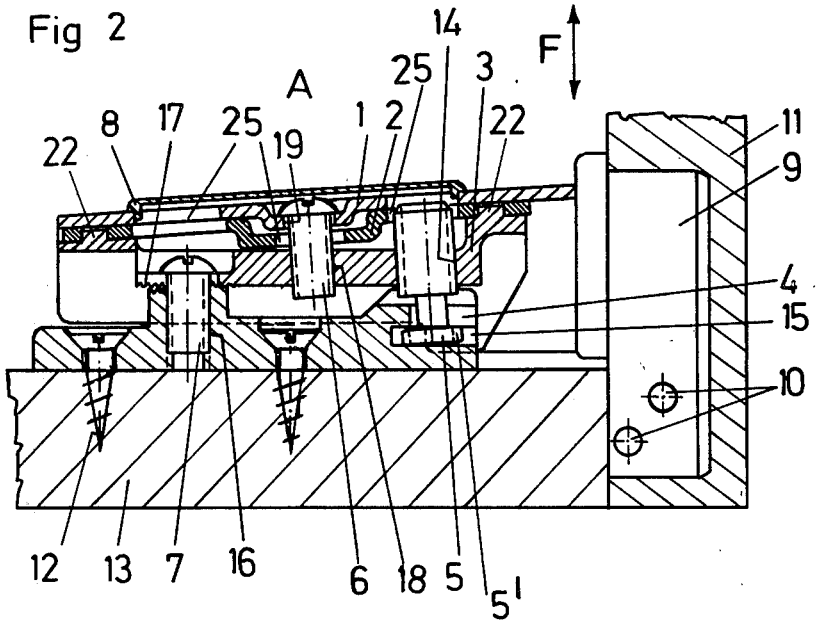
FIG. 2 is a sectional view along the longitudinal center axis L—L of FIG. 1.
Figure 3:
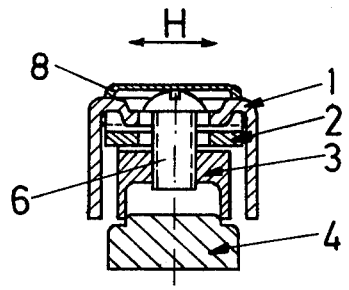
FIG. 3 is a transverse cross-sectional view of the hinge arm, the intermediate member and the base plate.
Figure 4:
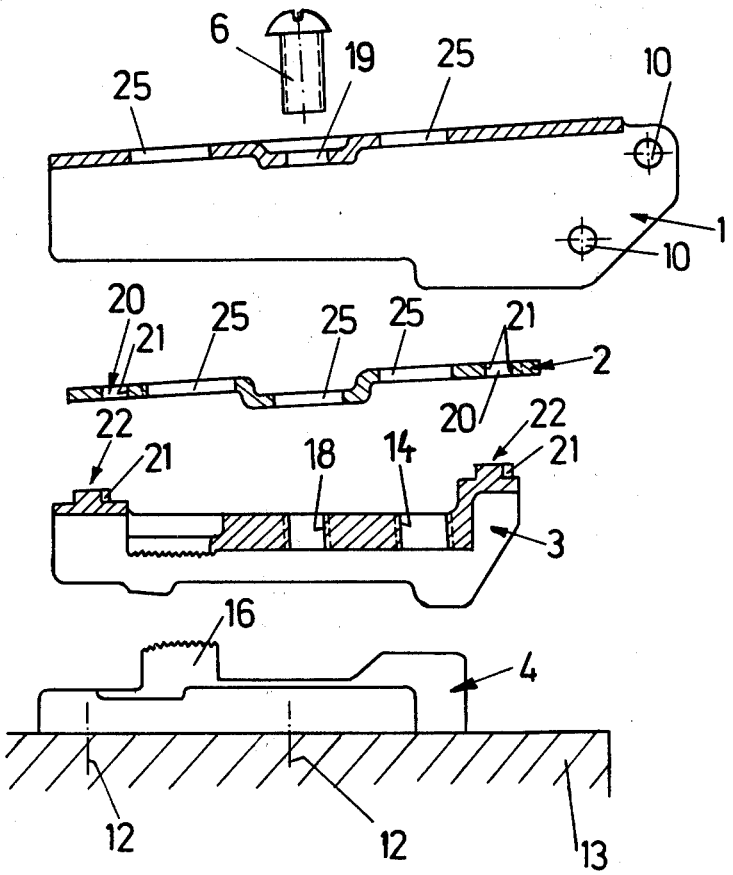
FIG. 4 is an exploded view of the hinge parts on the side of the hinge arm, parts thereof being shown in section.

If the height adjusting screw 6 is loosened, the hinge arm 1 can be moved in the direction of double arrow H (FIG. 1, FIG. 3). Hence, the oblique guiding faces 21 of the projections 22 and of the slots 20 effect a displacement of the guiding member 2 in the direction of arrow T.

After alignment operation, the height adjusting screw 6 is tightened.

By means of the illustrated arrangement, a tilting movement of the hinge arm 1 on the base plate 4 causing an excessive downward movement of the door 11 is largely eliminated.

The guiding member 2 and the hinge arm 1 are provided with various openings 25 so that tools have access to the clamping- and adjusting screws 7, 5. Openings 25 are obviously adapted to provide access for a tool in any position of the hinge arm 1 and of the guiding member 2.

After the adjustment and positioning of the hinge arm 1, and, hence, of the whole hinge, openings 25 are covered by means of a cover cap 8 which is arranged on the hinge arm 1.

In the embodiment according to FIGS. 5 through 7, and 13 the base plate 4 is made of plastics material and comprises two semishells 4'.

In this embodiment, the base plate 4 can be a box profile, the base plate having a chamber 8.

The semishells 4' each have a recess 8' corresponding to half of chamber 8.

In the mounted position, the intermediate member 3 is arranged in the chamber 8. Intermediate member 3 is preferably of metal and plate-shaped.

Intermediate member 3 is displaceable in the direction of the height of the article of furniture, i.e. parallel to the rotational axis of the hinge. This means that the breadth b of the intermediate member 3 is smaller than the inner width l' of the chamber 8.

A female thread 18 is provided in the intermediate member 3, the fastening screw 6 for the hinge arm 1 being mounted in such female thread in the mounted position.

The fastening screw 6 extends through a slot 19 allowing the depth adjustment of the hinge arm 1 and, hence, of the door wing 11 of the piece of furniture.

In the region of the female thread 18, the intermediate member 3 is provided with a pedestal which increases the stability of the base plate construction according to the invention.

Such pedestal extends through an aperture 26 in the base plate 4, aperture 26 being formed by two recesses 26' in the two semishells 4'.

The size of the aperture 26 is dimensioned in such a manner that the pedestal does not hinder the displacement of the intermediate member 3.

The guiding member 2 is on its lower side provided with oblique guiding grooves 20 in which guiding flanges 22 of the base plate 4 engage in the mounted position.

Due to the fact that the guiding flanges 22 and the guiding grooves 20 are oblique they receive a part of the door weight, when the door 11 is in the mounted position, so that the hinge can be exposed to forces which are stronger than the forces which the fastening screw 6 could alone transmit to the base plate 4.

It does not matter that in this embodiment the device for the height adjustment of the hinge effects a depth adjustment as well, as there is only one fastening screw 6 for the depth as well as for the height adjustment and fastening.

As a height adjustment is not always required, supporting flanges 27 are provided in the chamber 8 of the base plate 4, flanges 27 keeping the intermediate member 3 in a centered position.

The hinge arm 1 has a U-shaped profile and rests with its two lateral flanges against opposite sides of the guiding member 2.

A joint adjusting screw 5 is arranged in the hinge arm 1, screw 5 being mounted in a female thread of the hinge arm 1 and resting against the guiding member at the end thereof directed towards the door 11.

When mounting the hinge, the hinge arm 1 is retained on the base plate 4 by means of the intermediate member 3 and the fastening screw 6, which has not been fully fastened.

By turning the joint adjusting screw 5, the door 11 can be adjusted in the direction of the breadth of the door joint.

The adjustment of the hinge in the direction of the depth of the article of furniture is effected by displacing it manually. The adjustment in the direction of the height of the article of furniture may be effected after breaking out and removing the supporting flanges 27. After the adjusting operation, the fastening screw 6 is fully fastened, and all parts of the adjusting mechanism of the hinge are clamped to one another.

FIGS. 8 through 11 show various embodiments for the arrangement of the guiding member 2 and the type of adjustment for the hinge arm 1.

Figure 8A:
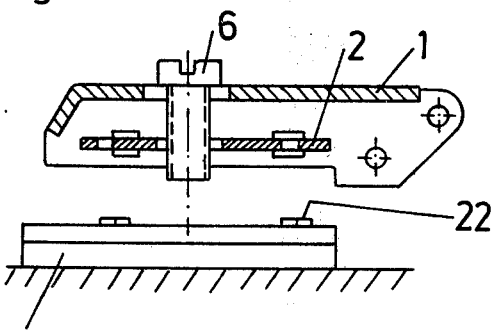
FIGS. 8 through 11 are schematic views of the hinge arms and base plates of various embodiments of height adjustment mechanisms according to the invention, FIGS. 8*a*, 9*a*, 10*a* and 11*a* being longitudinal sectional views, FIGS. 8*b*, 9*b*, 10*b* and 11*b* being plan views, and FIGS. 8*c*, 9*c*, 10*c* and 11*c* being cross-sectional views.
Figure 8C:
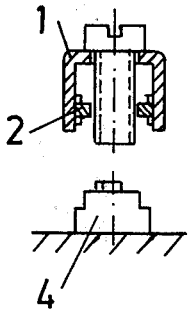
Figure 8B:
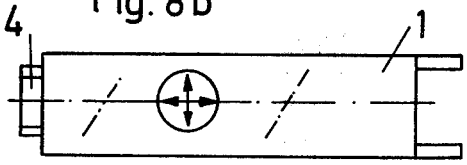

In the embodiment according to FIGS. 8*a*–8*c*, the guiding member 2 is retained in the hinge arm 1. Guiding member 2 also has slot-shaped recesses 20 into which projections 22 arranged on the base plate 4 extend.

Figure 9A:
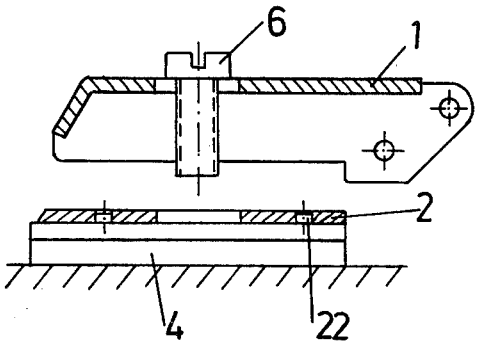
Figure 9C:
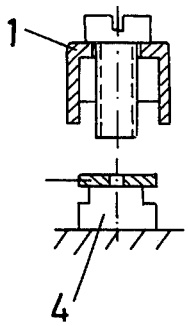
Figure 9B:
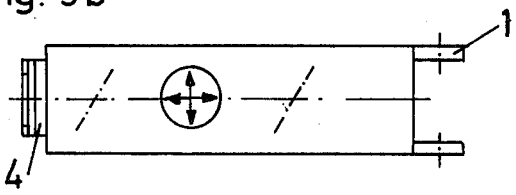

FIGS. 9*a*–9*c* show a similar embodiment. Projections 22 are provided on the base plate 4. The guiding member 2 is mounted, however, directly on the base plate.

Figure 10A:
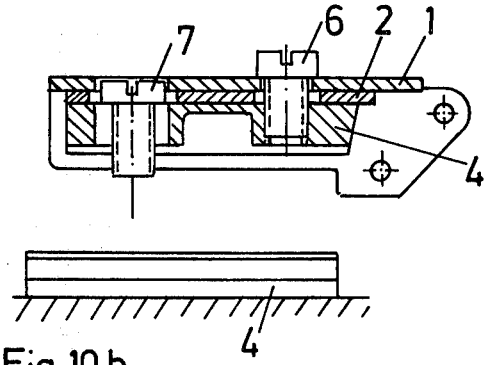
Figure 10C:
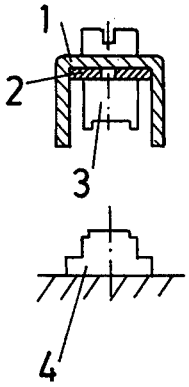
Figure 10B:
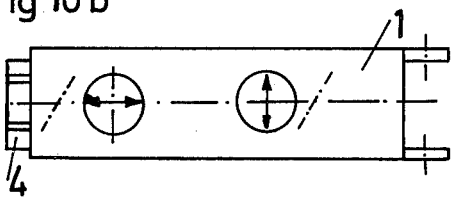

In the embodiment according to FIGS. 10*a*–10*c* an intermediate member 3 again is provided. The oblique guiding and the displacement is carried out between the guiding member 2 and the intermediate 3. Projections may again be provided on the intermediate member 3, such projections extending into slot-shaped recesses in the guiding member 2.

The hinge arm 1 is retained on the intermediate member 3 by means of a clamping screw 6. Intermediate member 3 is fastened to the base plate 4 by means of a clamping screw.

Figure 11A:
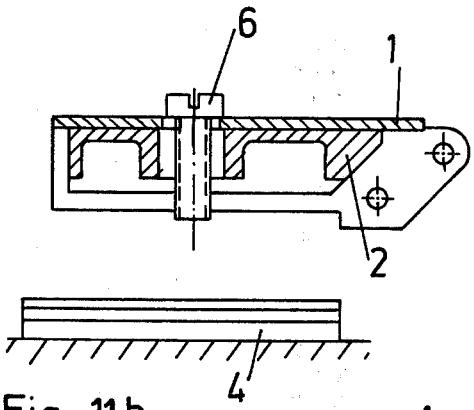
Figure 11C:
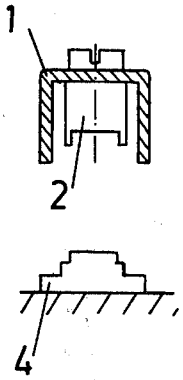
Figure 11B:
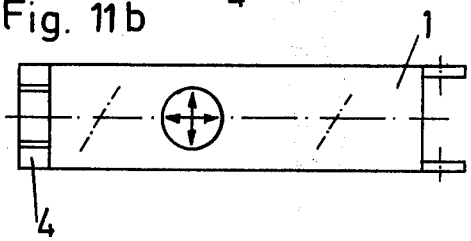
Figure 12:
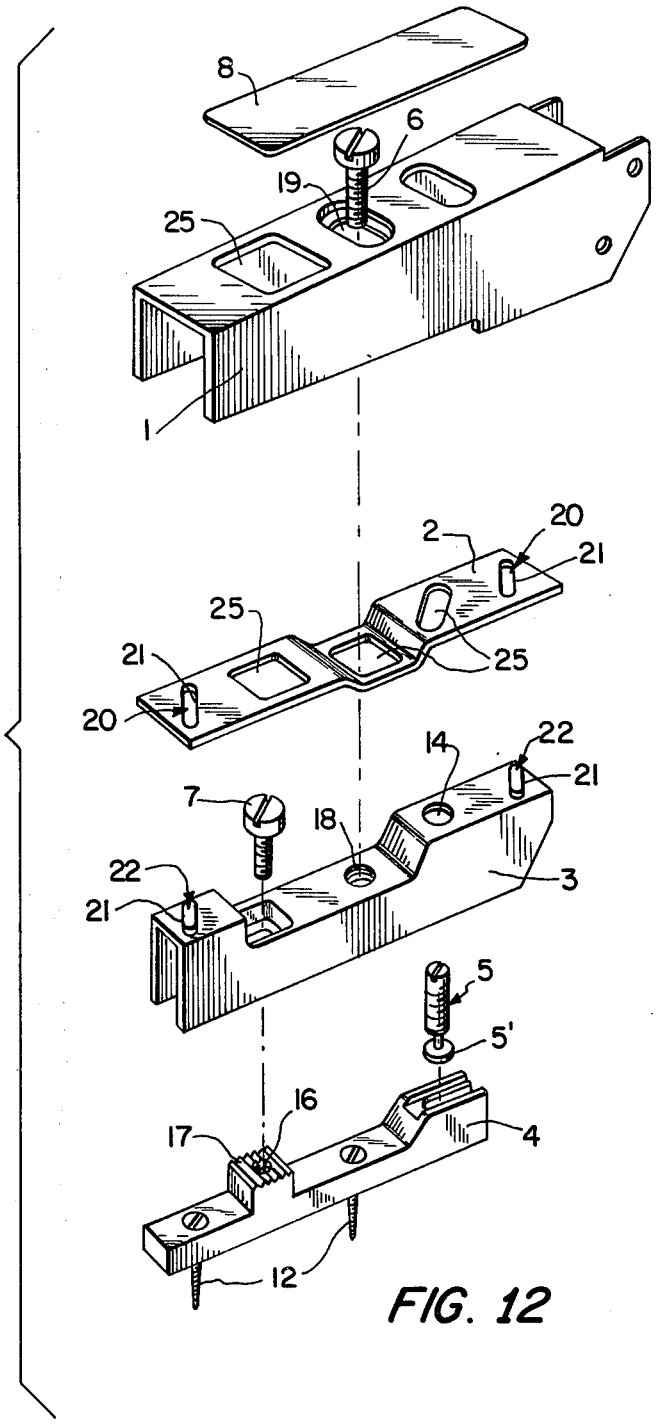
FIG. 12 is an exploded perspective view of the embodiment of FIGS. 1–4.
Figure 13:
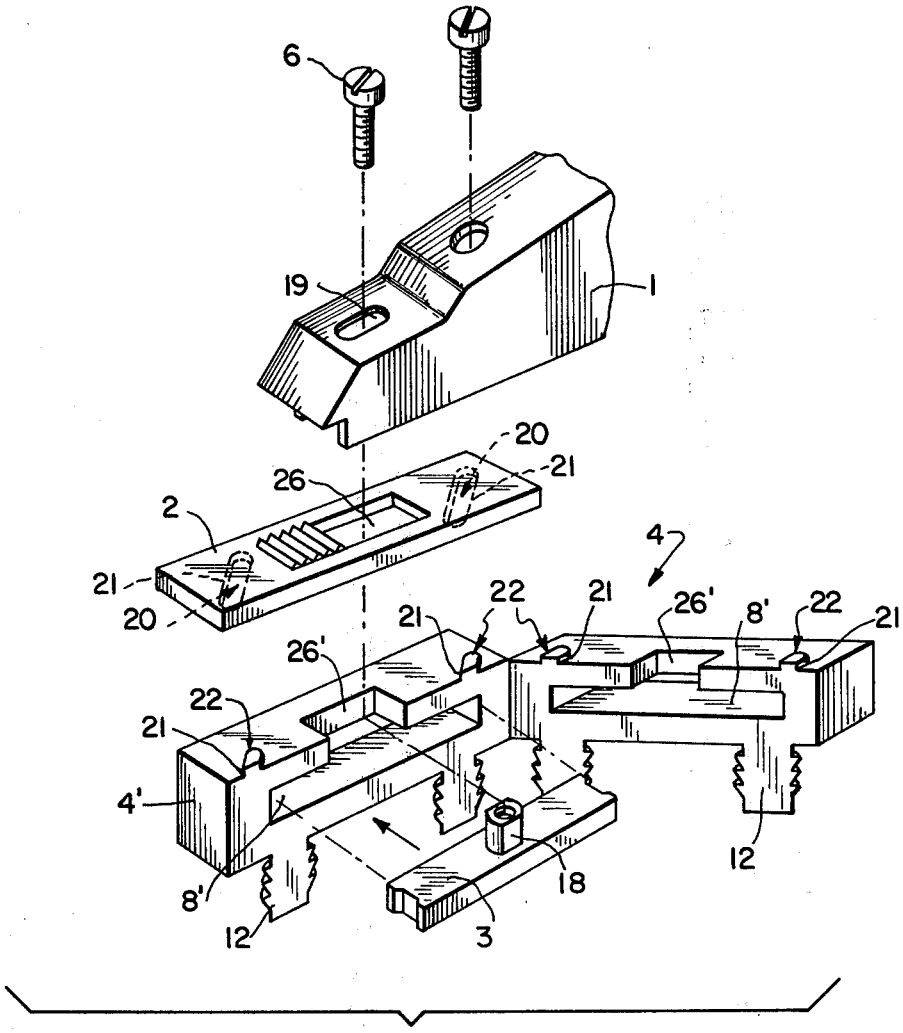
FIG. 13 is an exploded perspective view of the embodiment of FIGS. 5–7.

In the embodiment according to FIGS. 11*a*–11*c*, the oblique guiding is carried out between the hinge arm 1 and the guiding member 2. Guiding member 2 is displaceable on the base plate 4 in the direction of the depth of the piece of furniture. The oblique guiding can be effected by means of slots and projections extending into the slots.

What is claimed is:

1. A furniture hinge comprising:

a supporting member adapted to be mounted on a wall portion of an article of furniture;

a hinge arm adapted to be connected to a door of an article of furniture so that the door is pivotal with respect to the wall portion about a rotational axis, said hinge arm having a U-shaped cross-sectional configuration and a longitudinal center axis;

clamping screw means for clamping said hinge arm to said supporting member in an orientation such that said longitudinal center axis is adapted to extend transverse to the rotational axis, said clamping screw means being capable of being loosened so that the position of said hinge arm with respect to said supporting member is adjustable; and guiding means, positioned between said hinge arm and said supporting member, for guiding adjusting movement of said hinge arm with respect to said supporting member in a direction parallel to the mounting plane of said supporting member and oblique to said longitudinal center axis without altering the orientation of said longitudinal center axis with respect to the rotational axis of said supporting member, said guiding means comprising a guiding member positioned within the U-shaped profile of said hinge arm, said guiding member and said supporting member having mutually abutting surfaces extending in directions inclined to said longitudinal center axis and parallel to said mounting plane.

2. A hinge as claimed in claim 1, wherein said guiding member is laterally guided in a direction parallel to said longitudinal center axis by one of said hinge arm and said supporting member.

3. A hinge as claimed in claim 2, wherein said guiding member has side faces slidably contacting faces of lateral walls of said hinge arm.

4. A hinge as claimed in claim 3, wherein said guiding member has recesses formed in opposite sides thereof, defining slide faces at opposite end portions thereof, only said slide faces contacting said faces of said lateral walls of said hinge arm.

5. A hinge as claimed in claim 1, wherein said abutting surfaces comprise surfaces of recesses in one of said guiding member and said supporting member and surfaces of projections extending from the other of said supporting member and said guiding member into said recesses.

6. A hinge as claimed in claim 5, wherein said recesses are in said guiding member, and said projections extend from said supporting member.

7. A hinge as claimed in claim 6, wherein said supporting member comprises a base plate adapted to be mounted on the wall portion of the article of furniture, and an intermediate member adjustably mounted with respect to said base plate.

8. A hinge as claimed in claim 7, wherein said projections extend from said intermediate member.

9. A hinge as claimed in claim 7, wherein said projections extend from said base plate.

10. A hinge as claimed in claim 9, wherein said base plate comprises a pair of half shell-like members having therein recesses and joined such that said recesses define a chamber within said base plate, said intermediate member being positioned within said chamber.

11. A hinge as claimed in claim 1, wherein said guiding member comprises a narrow metal plate.

* * * * *